US008803413B2

(12) United States Patent
Guo et al.

(10) Patent No.: US 8,803,413 B2
(45) Date of Patent: Aug. 12, 2014

(54) SYMMETRIC QUADRUPOLE STRUCTURED FIELD EMISSION DISPLAY WITHOUT SPACER

(76) Inventors: Tailiang Guo, Fujian (CN); Yun Ye, Fujian (CN); Zhixian Lin, Fujian (CN); Yongai Zhang, Fujian (CN); Liqin Jiu, Fujian (CN); Yuxiang You, Fujian (CN)

( * ) Notice: Subject to any disclaimer, the term of this patent is extended or adjusted under 35 U.S.C. 154(b) by 371 days.

(21) Appl. No.: 13/502,484

(22) PCT Filed: Aug. 12, 2011

(86) PCT No.: PCT/CN2011/078351

§ 371 (c)(1),
(2), (4) Date: Apr. 17, 2012

(87) PCT Pub. No.: WO2012/119387

PCT Pub. Date: Sep. 13, 2012

(65) Prior Publication Data

US 2014/0111083 A1 Apr. 24, 2014

(51) Int. Cl.

| | |
|---|---|
| ***H01J 1/62*** | (2006.01) |
| ***H01J 63/04*** | (2006.01) |
| ***H01J 29/08*** | (2006.01) |
| ***H01J 31/12*** | (2006.01) |

(52) U.S. Cl.

CPC ..... *H01J 63/04* (2013.01); *H01J 29/08* (2013.01); *H01J 2329/4608* (2013.01); *H01J 2329/4669* (2013.01); *H01J 2329/4682* (2013.01); *H01J 31/127* (2013.01)

USPC ..... 313/497; 313/306; 313/355

(58) Field of Classification Search

CPC ..... H01J 2329/00; H01J 2329/02; H01J 2329/18; H01J 2329/46; H01J 2329/4608; H01J 2329/4634; H01J 2329/4669; H01J 2329/4673; H01J 2329/4682

USPC ..... 313/495–497, 306, 309–310, 346, 351, 313/355

See application file for complete search history.

(56) References Cited

U.S. PATENT DOCUMENTS

| | | | | |
|---|---|---|---|---|
| 5,508,584 | A * | 4/1996 | Tsai et al. | 313/497 |
| 2005/0184644 | A1 * | 8/2005 | Moon | 313/497 |

* cited by examiner

*Primary Examiner* — Nimeshkumar Patel
*Assistant Examiner* — Jose M Diaz

(57) ABSTRACT

The present invention relates to a symmetric quadrupole structured field emission display without spacer comprising the upper and under substrates with a dielectric layer in between, wherein comb-like dielectric layer with lateral connection belts and a number of longitudinal working belts and longitudinal anodes are arranged on the upper substrate, bus electrodes are arranged longitudinally along the center on each anode, on the top, longitudinal alternating phosphor layer and dielectric layer for isolation on anode, gate electrodes are arranged on both sides of each longitudinal work belts, with the bus electrode as symmetry center, forming interdigital gate electrodes, horizontal cathode electrodes and longitudinal auxiliary electrodes are on the under substrate, resistor layer for current limiting and dielectric layer for cathode protection are arranged alternating horizontally on each cathode electrode, each intersect of the auxiliary electrode and cathode is isolated by the dielectric layer for cathode.

9 Claims, 4 Drawing Sheets

SYMMETRIC QUADRUPOLE STRUCTURED FIELD EMISSION DISPLAY WITHOUT SPACER

TECHNICAL FIELD

This invention is involved with the fabrication technique of field emission display, in particularly, to a symmetric quadrupole structured field emission display without spacer, whose anode and gate are arranged on the same substrate with bus electrodes as the center of symmetry.

TECHNICAL BACKGROUND OF THE INVENTION

The field emission display (FED) is a novel flat panel display, with flat field emission cathode array as electron source, phosphor as light-emitting material, and controlled in a way of matrix addressing. Compared to other types of displays, FED has the advantages of high image quality of the cathode ray tube (CRT), the slightness of liquid crystal display (LCD), and large scale of plasma display panels (PDP). The FED has the following excellent properties: small size, light weight, low energy consumption, long life, high image quality, high brightness, high resolution, full-color, multi-grayscale, high response speed, no viewing angle restrictions, wide working temperature range, simple structure, needless of heating the filament and the deflection coil or other components, the fabrication process is simple and low-cost for mass production, the image gray-scale and dynamic range are large, needless of polarized light, no harmful X-ray radiation, free to radiation and magnetic interference, self-luminous.

The FED can be classified into diode, triode and multiple structures.

The diode structure FED is composed of upper and under substrates. ITO transparent conductive electrode and three-color phosphor are fabricated on the upper substrate, cathode is fabricated on the under substrate followed by the preparation of CNT field emission materials. The electrodes on the two substrates are perpendicularly arranged, and isolated by the spacers. The fabrication process of diode structure FED is simple, low cost, thus is easy to realize large scale, while the turn-on voltage is very high. However, the voltage of anode can not be too high as it is connected to the drive circuit, which limits the use of high voltage phosphors and the enhancement of the lightness, as well as poor gray-scale reproduction. One need to increase the current density to maintain the high lightness, which will cause rapid aging of the phosphors, and decrease the lifetime of the devices. Without limiting the driving voltage, it is more difficult to design the drive circuit, and difficult to achieve fast dynamic display with multi-gray scale. Therefore, diode FED is limited in the practical application.

To achieve high gray-scale and enhance the lightness, researches of triode and multiple structures FED are inevitable.

Generally, the triode FED is composed of cathode, gate and anode, and can be classified into normal gate, under gate and planar gate structures. The triode FED uses gate to control the field emission of cathode, while not the high voltage as for the diode FED.

For the normal gate FED, cathode and gate are set on the same substrate, and anode on the other substrate, the distance between two substrates is kept by the spacers. The cathode is located under the gate, leading to a higher utilization rate of electrons emitted from the cathode. The cathode and the gate are perpendicularly aligned, with an insulating dielectric layer between the cathode and the gate to avoid the short circuit between the cathode and gate, the fabrication process is complicated and high costly. Usually, the fabrication of the dielectric layer and gate is followed by that of the electronic materials, so the cathode materials subject to damage and contamination during the preparation of the dielectric layer and gate. For this kind of FED, the leakage current of the insulating layer between cathode and gate is large, which will affect the lifetime of the device.

For the under gate FED, cathode and gate are also set on the same substrate, and anode on the other substrate, the distance between two substrates is kept by the spacers. The cathode is located on the gate, leading to a higher utilization rate of electrons emitted from the cathode. The cathode and the gate are perpendicularly aligned, with an insulating dielectric layer between the cathode and the gate to avoid the short circuit between the cathode and gate, the fabrication process is complicated and high costly. Usually, the fabrication of electronic materials is followed by that of the dielectric layer and gate, so damage and contamination of the cathode materials can be avoided during the preparation of the dielectric layer and gate. However, it is easy to cause the short circuit between the cathode and the gate after the fabrication of emission materials on the cathodes. Compared to normal gate FED, the fabrication of under gate FED is simpler, and is easier to realize. However, there are some short cuts such as: charge accumulation, serious dispersion of electrons, lager beam spot, and crosstalk between the adjacent pixel units. The crosstalk of the pixel unit can be reduced by narrowing the spacing of cathode and anode; however, it is not conducive to the increase of the anode voltage, leading to lower luminous efficiency.

For the planar FED, it is free of fabrication of dielectric layer which is necessary for the normal gate and under gate FED. The gate and cathode can be fabricated parallel at one time on the same planar of one substrate. The fabrication process is much simpler, however, it suffers a serious dispersion of electrons and lager beam spot, and need to use scan the high anode voltage to control the images.

On the other hand, FED is a vacuum device, which need some kind of supporting scaffold for isolation. The current technology is limited to fabricate the supporting structure alone; leading to the problems of distribution and placement of spacers.

In a word, it is necessary to develop a novel structured FED, which is needless of spacers between the two substrates, and having a fabrication process of cathode and gate. At the same time, it is able to achieve regulation under low voltage, avoid charge accumulation and cross-talk between two adjacent pixel unit caused by the dispersion of electrons, in order to further improve the uniformity and utilization rate of emitted electrons, and extend the lifetime of the devices.

SUMMARY OF THE INVENTION

The purpose of this invention is to provide a symmetric quadrupole structured field emission display without spacer, by overcoming the deficiencies of the existing technology. This field emitter is novel in structure, simple in fabrication process, low in adjusting voltage, and in favor for image uniformity and stable emission of electrons.

To achieve the above purpose, the technology options of this invention are: A symmetric quadrupole structured field emission display without spacer, comprising two parallel substrates which are adapted in the size, wherein a number of longitudinal strips of anode electrode are settled on the underside of the upper substrate side by side, the bus electrodes are settled on the anode along the longitudinal centerline, phosphor layer and anode dielectric layer are settled on the anode and bus electrode along the longitudinal alternating, comb-like dielectric layer is settled on the underside of the upper substrate, the comb-like dielectric layer is composed of lateral connection belts that are arranged in the flanking on the upper substrate and a number of longitudinal working belts that are arranged side by side on one side of the lateral connection belts, the longitudinal work belts and the anodes are parallel, and are arranged on the upper substrate where are not covered by the anode, longitudinal stripe-like gate A1 and A2 are arranged on both sides of each longitudinal work belts, with the bus electrode as symmetry center, interdigital gate electrodes are located on both sides of each anode, dielectric layer for gate protection is arranged on the gate A1 and A2, and on the longitudinal work belts that are not covered by the gate A1 and A2;

A number of horizontal stripe-like cathodes are arranged on the upper side of the under substrate side by side, resistor layer for current limiting B1, dielectric layer for cathode protection C1, resistor layer for current limiting B2 and the dielectric layer for cathode protection C2 are arranged on each cathode along the horizontal alternating, electron emission layer D1 and D2 are arranged on resistor layer for current limiting B1 and B2, a number of longitudinal strip-like auxiliary electrodes are arranged side by side and alternating perpendicular on the top of the cathode, each intersect of the auxiliary electrode and cathode is isolated by the dielectric layer for cathode protection C2;

Dielectric layer for isolation is arranged between the upper and under substrates, the two ends of the dielectric layer for isolation are both connected respectively to the dielectric layer for gate protection and dielectric layer for cathode protection C1.

The gate A1, A2, and phosphor layer on the upper substrate are aligned to the electron emission layer D1, D2 and dielectric layer for cathode protection C2 on the under substrate, when arrange the upper substrate and under substrate.

The dielectric layer for gate protection having a hole, the position of the openings is correspond to the electron emission layer D1, D2, the area ratio of the hole size and the dielectric layer for gate protection is 0~100%.

The thickness of the comb-like dielectric layer on the upper substrate is 10~1000 μm, the thickness of the dielectric layer for isolation on the anode is 10~1000 μm, the thickness of the dielectric layer for gate protection is 0.1~100 μm, the thickness of the dielectric layer for cathode protection C1, C2 is 0.1~100 μm, the thickness of the dielectric layer for isolation on the cathode is 10~1000 μm, the distance between the cathode and the anode, the cathode and the gate are adjusted by controlling the thickness of the comb-like dielectric layer, the dielectric layer for gate protection, the dielectric layer for cathode protection C1 and the dielectric layer for isolation.

The dielectric layer for isolation on the anode and the comb-like dielectric layer can be connected into a whole on the upper substrate.

The dielectric layer for gate protection is fabricated by the metal-oxide semiconductor materials.

The phosphor layer is also arranged on the longitudinal work belts of the comb-like dielectric layer and at the sidewall of dielectric layer for isolation on anode.

The conductivity of the bus electrodes is greater than that of anode; the materials of the anode, the bus electrode, the gate A1, A2, cathode, the auxiliary electrode, the resistor layer for current limiting B1, B2 can be Si, or single-layer film of Ag, Al, Cu, Fe, Ni, Au, Cr, Pt, Ti, or their multilayer film of composite or alloy film, or metal oxide of semiconductor film and slurry of Sn, Zn, In, or the metal particles of one or more metal elements of Ag, Al, Cu, Fe, Ni, Au, Cr, Pt, Ti.

The electron emitter comprise of 0-D, 1-D and 2-D micro- and nano-materials.

The benefits of the present invention are:

1. Simple fabrication process and low cost. It is needless of consideration for the fixation of spacers on the two substrates; the cathode and the gate are fabricated respectively on the upper substrate and the under substrate; it is also needless of fabrication of insulating dielectric layer between the anode and gate, since there are parallel without overlaps.

2. Uniform images. In this invention, gate A1 and A2 on the upper substrate are arranged on both sides of each anode, with the bus electrode as symmetry center, and form the interdigital structured electrodes, which ensures the uniformity of electron emission and uniformity of images.

3. Low adjusting voltage, stable and reliable emission of electrons. Auxiliary electrodes are arranged side by side and alternating perpendicular on the top of the cathode on the under substrate, which can reduce the adjusting voltage of gate, avoid the charge accumulation, and collect the electrons from the cathode, improve the color purity and the emission rate of the electron. When fabricating the electron emitters using electrophoresis deposition, the auxiliary electrodes can control the orientation of the electron emitters, which can further improve the properties of field emission and the devices.

4. Realization of large-scale FED display. In this invention, most of the fabrication process can be conducted using screen printing, which yield the fabrication of large-scale FED display.

5. Improve effectively the cross-talk between the adjacent pixel caused by the dispersion of electrons.

In the following, we provide further details of the present invention using some drawings and embodiments.

Figure 1:
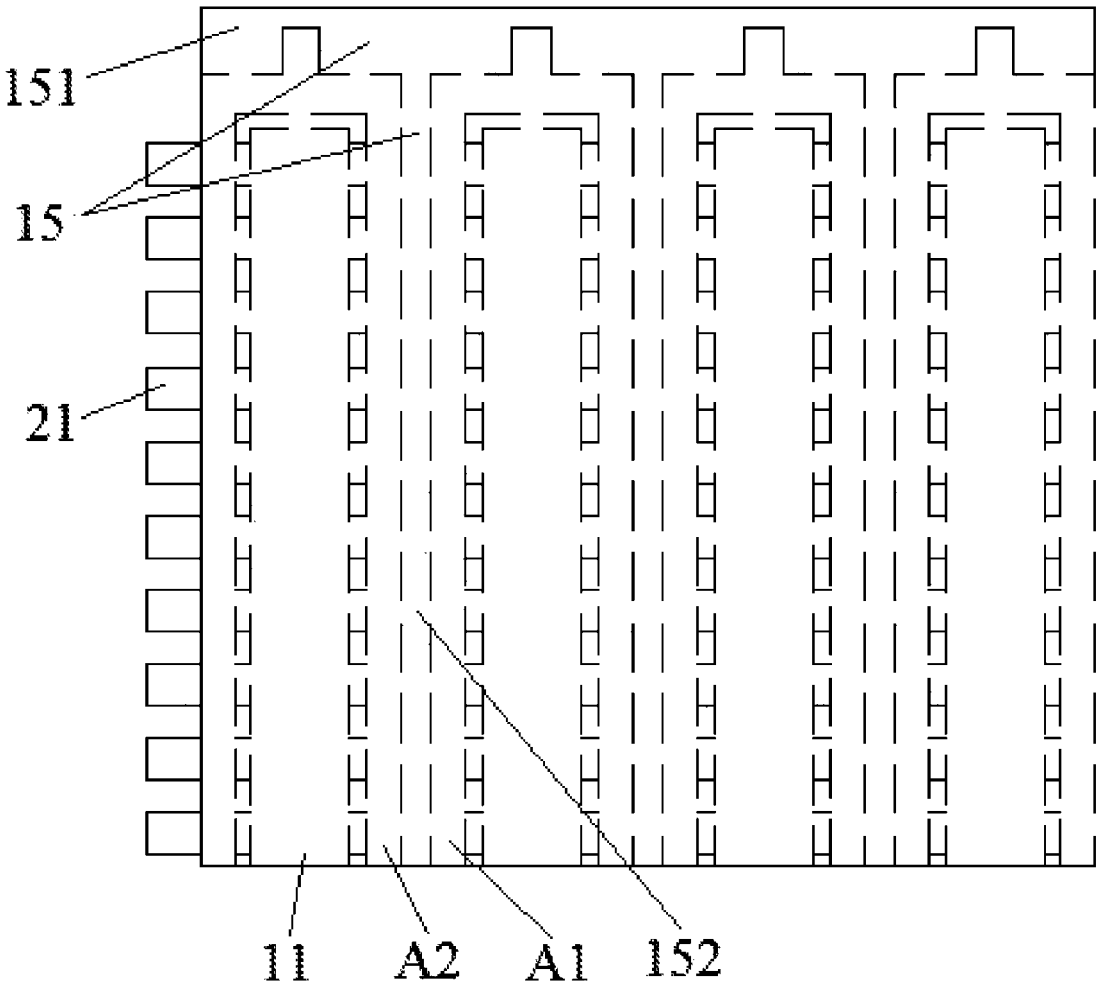
FIG. 1 shows the scheme of vertical view of this embodiment.

In the drawings, the main components are labeled as follows:

10—upper substrate; 11—anode; 12—bus electrode; 13—phosphor; 14—the dielectric layer for isolation on anode; 15—the comb-like dielectric layer; 151—the lateral connection belts; 152—the longitudinal work belts; A1—gate; A2—gate; 17—the dielectric layer for gate protection; 20—under substrate; 21—cathode; B1—the resistor layer for cathode current limiting; B2—the resistor layer for cathode current limiting; D1—electron emission layer; D2—electron emission layer; C1—the dielectric layer for cathode protection; C2—the dielectric layer for cathode protection; 26—the auxiliary electrode; 27—the dielectric layer for isolation.

DETAILED DESCRIPTION OF THE INVENTION

Figure 2:
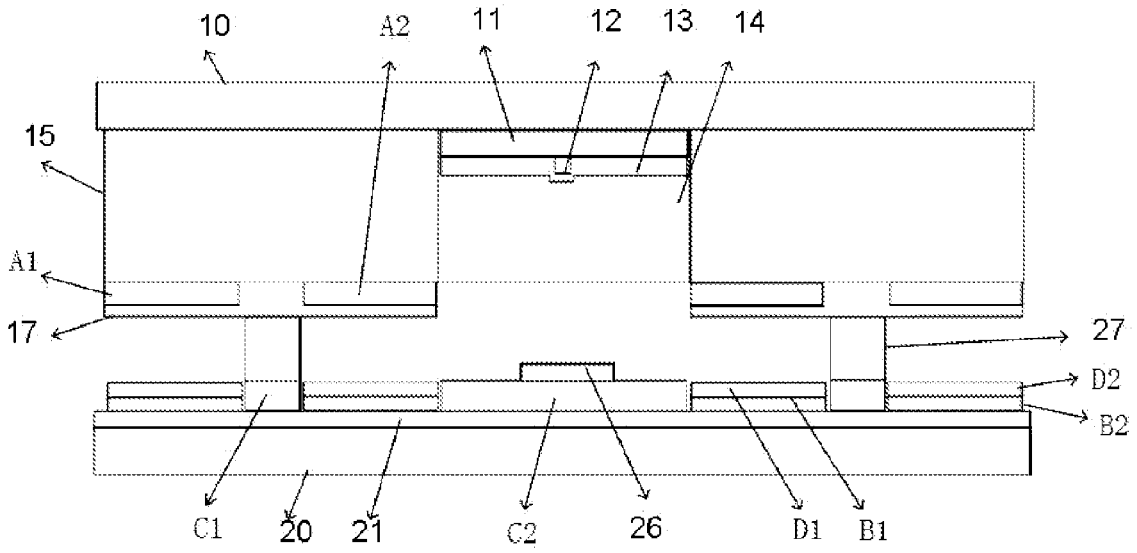
FIG. 2 shows the scheme of side view of this embodiment.
Figure 3:
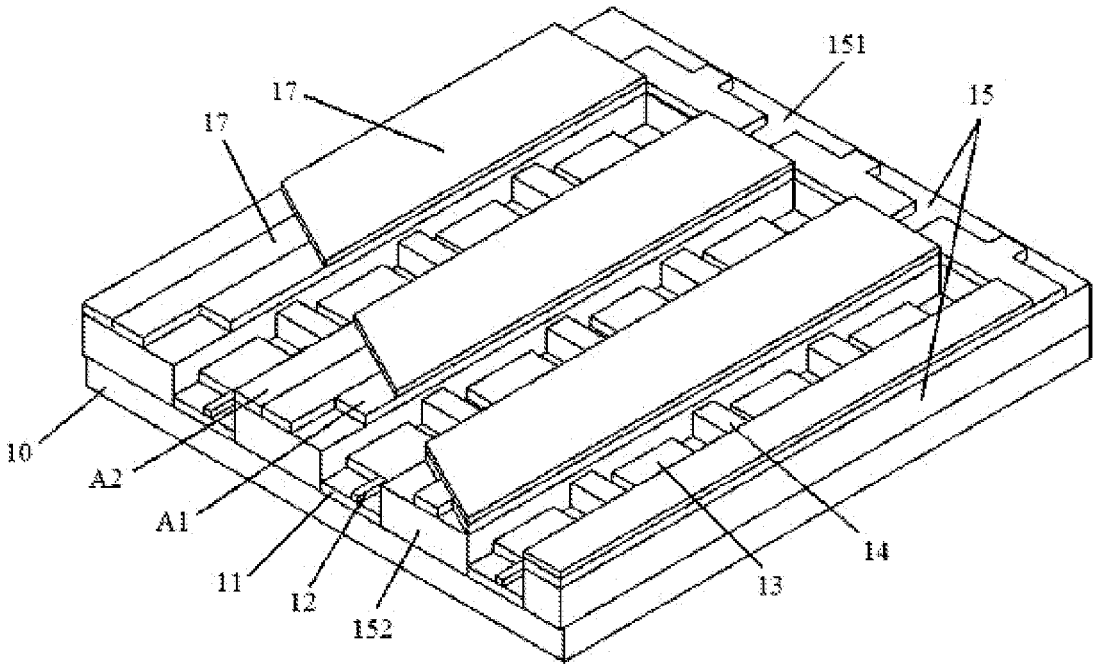
FIG. 3 shows the cutaway view of underside surface on upper substrate of this embodiment.
Figure 4:
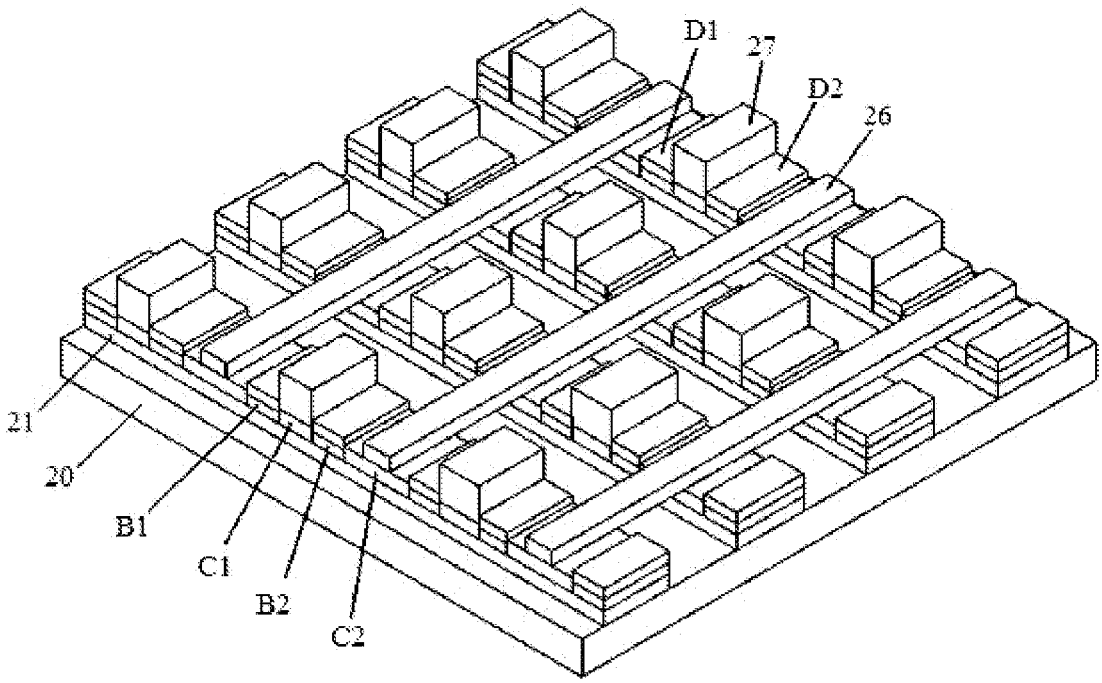
FIG. 4 shows the scheme of under substrate of this embodiment.

As shown in FIG. 1-4, the symmetric quadrupole structured field emission display without spacer, comprising two parallel substrates: upper substrate 10 and under substrate 20, which are adapted in the size, wherein a number of longitudinal strips of anode electrodes 11 are settled on the underside of the upper substrate 10 side by side, the bus electrodes 12 are settled on the anode 11 along the longitudinal centerline, phosphor layer 13 and anode dielectric layer 14 are settled on the anode 11 and bus electrode 12 along the longitudinal alternating, comb-like dielectric layer 15 is settled on the underside of the upper substrate 10, the comb-like dielectric layer 15 is composed of lateral connection belts 151 that are arranged in the flanking on the upper substrate 10 and a number of longitudinal work belts 152 that are arranged side by side on one side of the lateral connection belts 151, the longitudinal work belts 152 and the anodes 11 are parallel, and are arranged on the upper substrate 10 where are not covered by the anode 11, longitudinal strip-like gate A1 and A2 are arranged on both sides of each longitudinal work belts 152, with the bus electrode 12 as symmetry center, interdigital gate electrodes are located on both sides of each anode 12, dielectric layer for gate protection 17 is arranged on the gate A1 and A2, and on the longitudinal work belts that are not covered by the gate A1 and A2;

A number of horizontal strip-like cathodes 21 are arranged on the upper side of the under substrate 20 side by side, resistor layer for current limiting B1, dielectric layer for cathode protection C1, resistor layer for current limiting B2 and the dielectric layer for cathode protection C2 are arranged on each cathode along the horizontal alternating, electron emission layer D1 and D2 are arranged on resistor layer for current limiting B1 and B2, a number of longitudinal strip-like auxiliary electrodes 26 are arranged side by side and alternating perpendicular on the top of the cathode 21, each intersect of the auxiliary electrode 26 and cathode 21 is isolated by the dielectric layer for cathode protection C2;

Dielectric layer for isolation 27 is arranged between the upper substrate 10 and under substrate 20, the two ends of the dielectric layer for isolation 27 are both connected respectively to the dielectric layer for gate protection 17 and dielectric layer for cathode protection C1.

The gate A1, A2, and phosphor layer 13 on the upper substrate 10 are aligned to the electron emission layer D1, D2 and dielectric layer for cathode protection C2 on the under substrate 20, when arrange the upper substrate 10 and under substrate 20.

The thickness of the comb-like dielectric layer 15 on the upper substrate 10 is 10~1000 μm, the thickness of the dielectric layer for isolation on the anode 14 is 10~1000 μm, the thickness of the dielectric layer for gate protection 17 is 0.1~100 μm, the thickness of the dielectric layer for cathode protection C1, C2 is 0.1~100 μm, the thickness of the dielectric layer for isolation 27 on the cathode is 10~1000 μm, the distance between the cathode and the anode, the cathode and the gate are adjusted by controlling the thickness of the comb-like dielectric layer 15, the dielectric layer for gate protection 17, the dielectric layer for cathode protection C1 and the dielectric layer for isolation 27.

In order to reduce the cross-talk between the two adjacent pixels' caused by dispersion of electrodes, the dielectric layer for isolation on the anode 14 and the comb-like dielectric layer 15 can be connected into a whole on the upper substrate 10. At the same time, the phosphor layer 13 is also arranged on the longitudinal work belts 152 of the comb-like dielectric layer 15 and at the sidewall of dielectric layer for isolation on anode 14.

In order to improve the absorption rate of electrons on anodes and reduce the absorption number of electrons on gate, dielectric layer for gate protection 17 is fabricated on gate A1 and A2, the dielectric layer for gate protection 17 is fabricated by the metal-oxide semiconductor materials. The dielectric layer for gate protection 17 having a hole, the position of the openings is correspond to the electron emission layer D1, D2, the area ratio of the hole size and the dielectric layer for gate protection is (0~100%).

The conductivity of the bus electrodes 12 is greater than that of anode 11; the materials of the anode 11, the bus electrode 12, the gate A1, A2, cathode, the auxiliary electrode 26, the resistor layer for current limiting B1, B2 can be Si, or single-layer film of Ag, Al, Cu, Fe, Ni, Au, Cr, Pt, Ti, or their multilayer film of composite or alloy film, or metal oxide of semiconductor film and slurry of Sn, Zn, In, or the metal particles of one or more metal elements of Ag, Al, Cu, Fe, Ni, Au, Cr, Pt, Ti. The electron emitter comprise of 0-D, 1-D and 2-D micro- and nano-materials.

In this invention, the fabrication processes of under substrate 20 are as follows:

1. Fabrication of the cathode electrodes 21: the starting material of the under substrate 20 is transparent glass, first, the strip-like cathode electrodes 21 can be fabricated either using screen printing of conducting materials on under substrate 20, or using photolithography if there is a layer of conducting film on the under substrate 20. In this embodiment, preferentially, we use magnetron sputtering to deposit CrCuCr conducting film on the glass substrate 20, and then fabricate the CrCuCr strips (cathode electrode 21) after a series of processes like exposure, development and etching.

2. Fabrication of resistor layer for current limiting B1 and B2 on the top of cathode electrodes 21. In this embodiment, first, a layer of conducting film is deposited on the surface of CrCuCr strip-like cathode 21, after exposure and etching processes, the strip-like resistor layer for current limiting B1 and B2 are formed on the top of cathode, finally, the substrate is annealed under vacuum condition or under the protection of N2 to remove the organic solvents.

3. Fabrication of dielectric layer for cathode protection C1 and C2, dielectric layer for isolation 27 on the strip-like cathode 21. The thickness of the dielectric layer for cathode protection C1, C2 is 0.1~100 μm, the thickness of the dielectric layer for isolation 27 on the cathode is 10~1000 μm. The dielectric layer for cathode protection C1 and C2, the dielectric layer for isolation 27 are fabricated on the part of cathode 21 where is not covered by the resistor layer for current limiting B1 and B2 using screen printing, photolithography or coating. In this embodiment, preferentially, a layer of dielectric film is printed on the part of cathode 21 where is not covered by the resistor layer for current limiting B1 and B2 using screen printing, after exposure and etching, the substrate is sintered under the protection of N2 to form the dielectric layer for cathode protection C1 and C2, dielectric layer for isolation 27.

4. Fabrication of auxiliary electrodes 26. The auxiliary electrodes can be fabricated directly by screen printing or by the exposure, development and solid heating of the light sensitive silver slurry. In this embodiment, preferentially, we directly print the silver slurry as auxiliary electrodes using screen printing. That is, a number of longitudinal strip-like auxiliary electrodes 26 are arranged side by side and alternating perpendicular on the top of the cathode 21, each intersect of the auxiliary electrode 26 and cathode 21 is isolated by the dielectric layer for cathode protection C2. Finally, the substrate is sintered to remove the organic slurry.

5. Fabrication of electron emission layer D1, D2 on the resistor layer for current limiting B1 and B2. This step can be achieved by transferring the field emission nano-materials on the resistor layer for current limiting using electrophoresis, screen printing, spraying, and chemical vapor deposition. In this embodiment, preferentially, CNTs are deposited on the resistor layer for current limiting B1 and B2 using electrophoresis.

In this invention, the fabrication processes of upper substrate 10 are as follows:

1. Fabrication of anode 11. The strip-like anode 11 is fabricated on the transparent conducting glass substrate 10 using exposure and etching. Preferentially, we screen print photoresist on the ITO substrate 10, after exposure and etching, we get the strip-like anode 11.

2. Fabrication of bus electrodes 12 on the anode 11. The bus electrodes 12 on the anode 11 can be realized using screen printing and/or photolithography, the area of bus electrodes 12 is smaller than that of the anode 11, and can be located at the center of the anode 11. Preferentially, we print a layer of conducting and photo sensitive silver slurry on the substrate with prepared anode 11, after exposure and development, and sintered under the protection of N2, we achieve the bus electrodes 12, whose area is about 5% of that of anode 11.

3. Fabrication of comb-like dielectric layer 15 and dielectric layer for isolation on anode 14 after the fabrication of bus electrodes 12 on the anode 11. The thickness of the comb-like dielectric layer 15 is 10~1000 μm, the thickness of the dielectric layer for isolation on the anode 14 is 10~1000 μm. Method 1: we print a layer of photo sensitive dielectric layer on the substrate with prepared anode 11 and bus electrode 12, after exposure and development, we achieve the comb-like dielectric layer 15 and dielectric layer for isolation on anode 14; Method 2: the comb-like dielectric layer 15 and dielectric layer for isolation on anode 14 are printed directly on the substrate using screen printing. Finally, the substrate is sintered under the protection of $N_2$.

4. Fabrication of gate A1 and A2. Method 1: we print a layer of conducting and photo sensitive silver slurry on the substrate, after exposure and development, we achieve the gate A1 and A2; Method 2: the gate A1 and A2 are printed directly on the substrate using screen printing. Finally, the substrate is sintered under the protection of N2.

5. Fabrication of dielectric layer for gate protection 17. The thickness of the dielectric layer for gate protection 17 is 0.1~100 μm, and can be achieved by screen printing, exposure-etching, and spraying, followed by sintering under the protection of N2. Preferentially, the dielectric layer for gate protection 17 is printed directly on the gate electrode A1 and A2 using screen printing.

6. Fabrication of phosphor layer 13 on the anode 11 where is not covered by the dielectric layer for isolation on anode 14 using screen printing, spraying, and electrophoresis. The phosphor layer 13 can be located on the anode 11 where is not covered by the dielectric layer for isolation on anode 14 or at the side wall of the dielectric layer for isolation on anode 14. Preferentially, the phosphor layer 13 is deposited both on the anode 11 where is not covered by the dielectric layer for isolation on anode 14 and at the side wall of the dielectric layer for isolation on anode 14 using screen printing.

For the symmetric quadrupole structured field emission display without spacer presented in the embodiment, a high voltage is applied on the anode 11, and a low voltage is applied on the auxiliary electrodes 26. The electron emission layers D1, D2 emit electrons under the electric field of gate A1 and A2. Some of the electrons absorb by the gate A1, A2 and the auxiliary electrodes 26, some other electrons bombard the phosphors layer 13 on the anode 11 under the electric field of anode, which will cause luminescence, leading to the field emission display. The symmetric quadrupole structured field emission display without spacer will regulate the field emission of the emission layer by controlling the gate voltage; the anode collects the electrons which will bombard the R, G, B three-color phosphors, leading to the luminescence and display of image. The auxiliary electrodes 26 can enhance the regulation effects of voltage on gate, and reduce the electron absorbencies of gate A1, A2, thereby, increase the electron emission rate and the electron accumulation.

Although the present invention has been described with respect to the foregoing preferred embodiments, it should be understood that various other changes, omissions and deviations in the form and detail thereof may be made without departing from the scope of this invention.

The invention claimed is:

1. A symmetric quadrupole structured field emission display without spacer, comprising two parallel substrates which are adapted in the size, wherein a number of longitudinal strips of anode electrode are settled on the underside of the upper substrate side by side, the bus electrodes are settled on the anode along the longitudinal centerline, phosphor layer and anode dielectric layer are settled on the anode and bus electrode along the longitudinal alternating, comb-like dielectric layer is settled on the underside of the upper substrate, the comb-like dielectric layer is composed of lateral connection belts that are arranged in the flanking on the upper substrate and a number of longitudinal working belts that are arranged side by side on one side of the lateral connection belts, the longitudinal work belts and the anodes are parallel, and are arranged on the upper substrate where are not covered by the anode, longitudinal strip-like gate A1 and A2 are arranged on both sides of each longitudinal work belts, with the bus electrode as symmetry center, interdigital gate electrodes are located on both sides of each anode, dielectric layer for gate protection is arranged on the gate A1 and A2, and on the longitudinal work belts that are not covered by the gate A1 and A2;

a number of horizontal strip-like cathodes are arranged on the upper side of the under substrate side by side, resistor layer for current limiting B1, dielectric layer for cathode protection C1, resistor layer for current limiting B2 and the dielectric layer for cathode protection C2 are arranged on each cathode along the horizontal alternating, electron emission layer D1 and D2 are arranged on resistor layer for current limiting B1 and B2, a number of longitudinal strip-like auxiliary electrodes are arranged side by side and alternating perpendicular on the top of the cathode, each intersect of the auxiliary electrode and cathode is isolated by the dielectric layer for cathode protection C2;

dielectric layer for isolation is arranged between the upper and under substrates, the two ends of the dielectric layer for isolation are both connected respectively to the dielectric layer for gate protection and dielectric layer for cathode protection C1.

2. The symmetric quadrupole structured field emission display without spacer according to claim 1, wherein the gate A1, A2, and phosphor layer on the upper substrate are aligned to the electron emission layer D1, D2 and dielectric layer for cathode protection C2 on the under substrate, when arrange the upper substrate and under substrate.

3. The symmetric quadrupole structured field emission display without spacer according to claim 1, wherein the dielectric layer for gate protection having a hole, the position of the hole is correspond to the electron emission layer D1, D2, the area ratio of the hole and the dielectric layer for gate protection is 0~100%.

4. The symmetric quadrupole structured field emission display without spacer according to claim 1, wherein the thickness of the comb-like dielectric layer on the upper substrate is 10~1000 μm, the thickness of the dielectric layer for isolation on the anode is 10~1000 μm, the thickness of the dielectric layer for gate protection is 0.1~100 μm, the thickness of the dielectric layer for cathode protection C1, C2 is 0.1~100 μm, the thickness of the dielectric layer for isolation on the cathode is 10~1000 μm, the distance between the cathode and the anode, the cathode and the gate are adjusted by controlling the thickness of the comb-like dielectric layer, the dielectric layer for gate protection, the dielectric layer for cathode protection C1 and the dielectric layer for isolation.

5. The symmetric quadrupole structured field emission display without spacer according to claim 1, wherein the dielectric layer for isolation on the anode and the comb-like dielectric layer can be connected into a whole on the upper substrate.

6. The symmetric quadrupole structured field emission display without spacer according to claim 1, wherein the dielectric layer for gate protection is fabricated by the metal-oxide semiconductor materials.

7. The symmetric quadrupole structured field emission display without spacer according to claim 1, wherein the phosphor layer is also arranged on the longitudinal work belts of the comb-like dielectric layer and at the sidewall of dielectric layer for isolation on the anode.

8. The symmetric quadrupole structured field emission display without spacer according to claim 1, wherein the conductivity of the bus electrodes is greater than that of the anode; the materials of the anode, the bus electrode, the gate A1, A2, the cathode, the auxiliary electrode, the resistor layer for current limiting B1, B2 can be Si, or single-layer film of Ag, Cu, Al, Fe, Ni, Au, Cr, Pt, Ti, or their multilayer film of composite or alloy film, or metal oxide of semiconductor film and slurry of Sn, Zn, In, or the metal particles of one or more metal elements of Ag, Cu, Al, Fe, Ni, Au, Cr, Pt, Ti.

9. The symmetric quadrupole structured field emission display without spacer according to claim 1, wherein the electron emitter comprising 0-D, 1-D and 2-D micro- and nano-materials.

* * * * *